US006830201B2

(12) United States Patent
Seelbach

(10) Patent No.: US 6,830,201 B2
(45) Date of Patent: Dec. 14, 2004

(54) HIGH PRESSURE CONTROL VALVE FOR A FUEL INJECTOR

(75) Inventor: Klaus Seelbach, Grand Rapids, MI (US)

(73) Assignee: Robert Bosch GmbH, Stuttgart (DE)

( * ) Notice: Subject to any disclaimer, the term of this patent is extended or adjusted under 35 U.S.C. 154(b) by 110 days.

(21) Appl. No.: 10/328,496

(22) Filed: Dec. 26, 2002

(65) Prior Publication Data

US 2004/0124257 A1 Jul. 1, 2004

(51) Int. Cl.[7] ..... F02M 47/02; F02M 39/00; B05B 1/30

(52) U.S. Cl. ..... 239/88; 239/533.3; 239/585.1; 239/585.5; 239/533.9

(58) Field of Search ..... 239/88–93, 533.2, 239/533.3, 533.9, 585.1–585.5; 251/129.15, 129.21, 27

(56) References Cited

U.S. PATENT DOCUMENTS 4,036,195 A 7/1977 Bailey
4,618,095 A 10/1986 Spoolstra
5,275,341 A * 1/1994 Romann et al. ..... 239/585.4
5,692,723 A * 12/1997 Baxter et al. ..... 251/129.21
5,749,717 A 5/1998 Straub et al.
5,954,487 A 9/1999 Straub et al.
6,019,091 A 2/2000 Spoolstra
6,019,344 A 2/2000 Engel et al.
6,053,421 A 4/2000 Chockley
6,059,545 A 5/2000 Straub et al.
6,158,419 A 12/2000 Jett et al.
6,173,915 B1 * 1/2001 Cohen et al. ..... 239/585.1
6,276,610 B1 8/2001 Spoolstra
6,328,232 B1 * 12/2001 Haltiner et al. ..... 239/585.1

* cited by examiner

*Primary Examiner*—Davis Hwu
(74) *Attorney, Agent, or Firm*—Brooks Kushman P.C.

(57) ABSTRACT

A fuel injector assembly comprising an engine camshaft driven piston plunger in a plunger body, a control valve, an electromagnetic actuator for stroking the control valve between limiting positions and a valve stop assembly establishing a first limiting valve stroke position when the control valve is fully open and a second valve stroke position corresponding to a reduced fuel delivery pressure prior to a main fuel pressure pulse in a fuel injection event.

8 Claims, 3 Drawing Sheets

Fig. 1
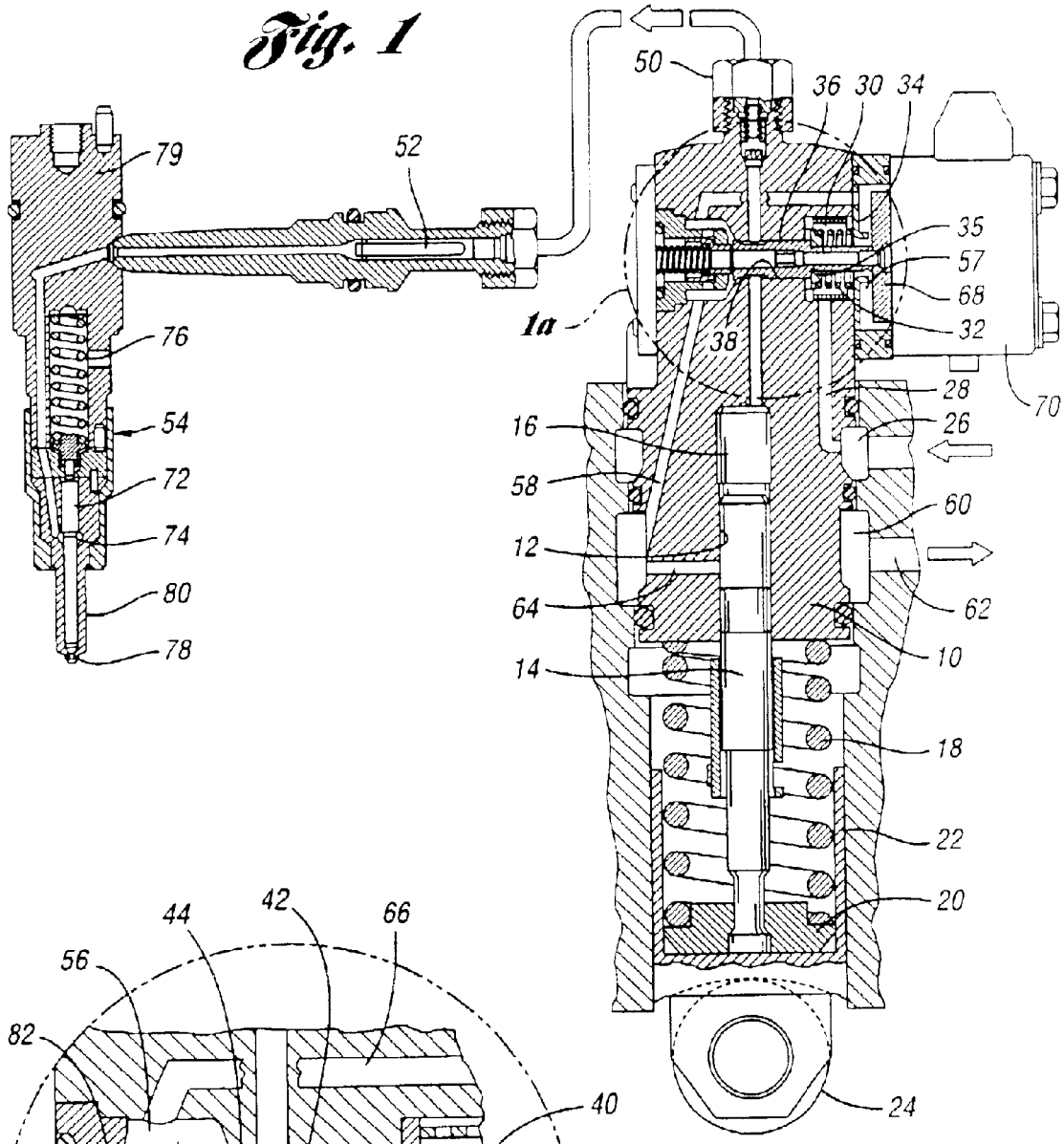
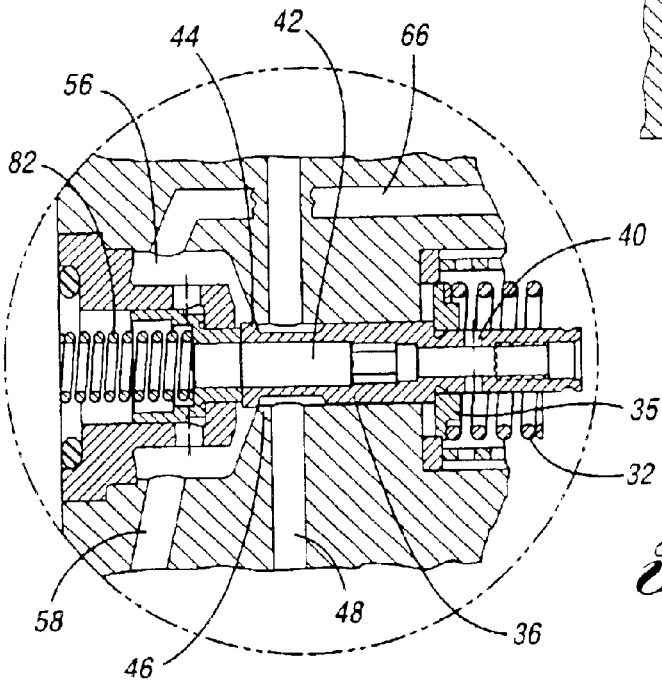
Fig. 1a

HIGH PRESSURE CONTROL VALVE FOR A FUEL INJECTOR

BACKGROUND OF THE INVENTION

1. Field of the Invention

The invention relates to current controlled rate shaping for a unit pump fuel injector system (UPS) or a unit fuel injector system (UIS) for an internal combustion engine.

2. Background Art

Unit pump or unit injector fuel systems for internal combustion engines, particularly diesel engines, are designed to control fuel injection quantity and injection timing. By choosing an engine valve cam profile and a nozzle design, the parameters of a typical triangular fuel injection pressure time trace can be influenced to match the needs of the combustion process of a specific engine design. As national and international emission standards become increasingly stringent, deviations from an ideal fuel injecting process become less tolerable.

It has been demonstrated that it is advantageous with some engine designs to avoid raising the injection pressure for a period following initiation of the injection event, or to raise it at a lower rate, before resorting again during the injection event to a typical triangular fuel injection pressure time trace shape with a higher rate of increase of injection pressure. Fuel injection rate shaping in this fashion is an effective technique for reducing levels of particulates and oxides of nitrogen in the engine exhaust and for reducing engine noise.

In order to achieve added injection rate shaping functions, an additional stop for the control valve between a fully open position and a fully closed position of the control valve has been used, as disclosed in U.S. Pat. No. 6,276,610, to allow for a controlled leakage of pressurized fuel through the control valve.

Unit pump and unit injector high pressure fuel injection systems of known construction comprise a pump body with a pump plunger driven by a valve camshaft for an internal combustion engine. The pump body and the plunger define a high pressure fuel pumping chamber that is in fluid communication with injection nozzles. A control valve, which is situated in a hydraulic circuit between the high pressure pumping chamber and the nozzle, is stroked by an electromagnetic actuator between an open position and a closed position. The stroke range includes a fully open position, a fully closed position and a rate shape position close to the fully closed position of the control valve.

The control valve position during a fuel injection event is controlled by an electronic engine control module and an electromagnetic actuator for stroking the control valve. The module responds to engine operating variables. The module includes an electronic processor with software that defines a calibrated time period for the injection event and the time period between injection events. The time period for a given injection event is characterized by an intermediate or modified pressure in a time plot of the fuel pressure at the nozzle. The intermediate pressure precedes a main injection pressure pulse.

The control valve normally is stroked to a fully open position by a valve spring. When the actuator is energized, the control valve strokes towards a closed position against the opposing force of the control valve spring. A control valve stop comprising a spring loaded piston engages an adjacent end of the control valve. The stop also comprises a secondary stop shoulder that is in engagement with the valve when the valve is fully open. A spring in the control valve stop reduces the net force of the control valve spring. The spring rate of the control valve stop spring is less than the spring rate of the control valve spring. When the piston in the control valve stop hits a piston stop shoulder, typically after 120 $\mu$m of stroke, a higher force is needed to pull the control valve to its fully closed position because the control valve stop spring does not oppose the control valve spring. That is due to a lack of contact between the control valve and the control valve stop piston during the final control valve travel of 30 $\mu$m.

The actuator has an armature connected to the control valve. The control valve is urged towards the closed position against the force of the control valve spring when the actuator stator is energized.

In a typical embodiment, the stroke of the valve between a so-called rate shape position and the closed position may be about 30 microns. The full stroke of the control valve between the fully opened position and the closed position may be about 150 microns. Active rate shaping occurs when the valve is in contact with the stop piston, thereby causing a net reduction of the spring force acting on the valve body. The pressure gradient at that time is reduced because of the controlled leakage of fluid past the control valve seat.

It is possible that the control valve and the control valve stop, during assembly of the injector, may have their centerlines misaligned or skewed. This has a potential for changing the effect of the stroking of the stop piston because the valve may engage the secondary stop shoulder before the stop piston is fully displaced against the force of the stop piston spring. Any deviations in the alignment of the valve with respect to the stop piston can have an undesirable influence on injection rate shaping during the injection event with a resulting deterioration of engine emission quality.

SUMMARY OF THE INVENTION

The assembly of the control valve and the control valve stop of the invention is designed to compensate for any misalignment or lack of concentricity of the control valve with respect to the stop piston. The stop piston is in engagement with the control valve regardless of any misalignment or lack of concentricity due to manufacturing tolerances. Because such tolerances will not affect the rate shaping characteristics of the injection event, it is possible to assemble the control valve stop in a pre-assembly procedure during manufacture of the unit pump or unit injector. In a high-volume manufacturing operation, provision is made, furthermore, to reduce the number of potential fluid leakage paths through which fluid could leak into engine oil due to a damaged seal ring, for example.

According to a further feature of the invention, the need for precisely calibrating the control valve and control valve stop assembly is eliminated by providing calibrated shims for establishing controlled strokes of the stop piston and the control valve. Assembly of the shims can take place in a pre-assembly procedure for the control valve stop.

The unit pump or unit injector of the invention includes a pump body with a cylindrical pumping chamber defined in part by an engine camshaft-driven plunger. A fuel inlet passage and a fuel delivery passage communicate with a movable control valve.

The control valve has a land that engages a valve seat in the pump body. A spill flow path from the fuel delivery passage to a fuel return passage is established when the control valve is stroked toward its open position. A control valve spring strokes the control valve toward its open position and an electromagnetic actuator strokes the control valve toward its closed position.

The stop adjacent one end of the control valve defines a first stop position of the valve to limit total valve travel. A second stop position is defined by the spring-loaded stop piston, which is in engagement with the control valve when the control valve is stroked to an intermediate position as the rate of pressure increase in the fuel delivery passage is reduced. Misalignment of the control valve stop piston relative to the control valve is accommodated when the control valve engages the stop piston.

BRIEF DESCRIPTION OF THE DRAWINGS

FIG. 1 is a cross-sectional view of a fuel injector pump and injector nozzle assembly capable of embodying the invention;

FIG. 1*a* is an enlarged, cross-sectional view of the control valve of the assembly of FIG. 1;

DETAILED DESCRIPTION OF PREFERRED EMBODIMENTS

Figure 2:
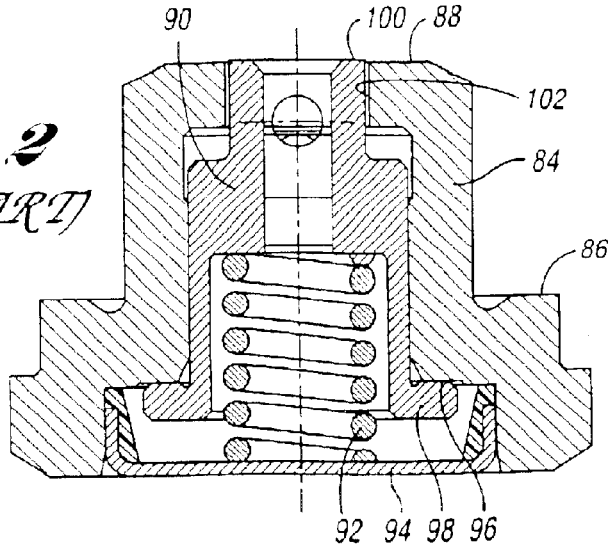
Fig. 2 (PRIOR ART)
FIG. 2 is a cross-sectional view of a conventional adjustable stop assembly for use with a control valve for a unit injector system (UIS) or unit pump system (UPS)

FIG. 1 shows an assembly of a known unit pump system. The invention will be described with reference to this unit pump system, but the invention can be used as well in a unit injector system.

The assembly of FIG. 1 includes a pump body 10 having a coaxially disposed cylindrical opening 12 in which a pump plunger 14 is fitted. The opening 12 and the plunger 14 cooperate to define a pumping chamber 16. The plunger 14 reciprocates over a stroke range within the cylindrical opening 12. A plunger spring 18 is seated on a spring seat 20 carried by the plunger 14. A spring guide sleeve 22 surrounds the spring 18 and the spring seat 20.

A cam follower 24 is carried by the sleeve 22 and is driven by an engine camshaft at one-half engine speed, thereby causing the plunger 14 to reciprocate in the cylindrical opening 12. Fuel from a low-pressure fuel pump (not shown) is delivered to annular cavity 26, which acts as a fuel inlet port. Fuel passes through inlet passage 28 to a spring cavity 30 formed in the upper portion of the pump body 10. A control valve spring 32 adjacent an actuator plate 34 is seated on a spring seat 35, which acts on a poppet control valve 36. The poppet control valve 36 is mounted within a valve chamber 38. Poppet control valve 36 includes radial ports 40 to allow for a pressure balance while the control valve is moving.

When the control valve 36 is in its normally open position, a valve land 44 is disengaged from valve seat 46, thereby permitting fluid to pass from the central opening 42 into fuel delivery passage 48, which extends to the pumping chamber 16. Passage 48 also extends through a fitting 50 and through a fuel passageway 52 to an injector nozzle holder assembly 54. When the control valve 36 is in the open position, fluid is distributed also to stop cavity 56 formed in the pump body 10. A fluid spill passage 58 extends from the chamber 56 to an annular space 60 in the pump body, which serves as an outlet port. This port communicates with flow return passage 62, which leads to the inlet side of the fuel pump. Any fluid leakage past the plunger 14 during the pumping stroke can drain back into the outlet port through passage 64.

During the retracting stroke of the plunger, fuel from the inlet port 26 is drawn through passage 28, control valve spring cavity 30, armature cavity 57, cross-over passage 66, stop cavity 56, across the open valve seat 46 into passage 48 and finally into plunger cavity 16.

During stroking of the plunger, fuel leaks through the open valve seat 46 into stop cavity 56. From there it flows through passage 58 and leaves the pump through the outlet port 60.

When the control valve is urged towards a closed position by energizing the electromagnetic actuator 70, injection pressure is built up and injection begins as soon as the pressure is high enough to overcome the force of spring 76 of the nozzle holder assembly 54, which biases the nozzle needle valve 72 towards a closed position.

Valve 36 is connected to an armature 68 for the electromagnetic actuator 70. When the actuator 70 is energized, the armature 68 is pulled towards the electromagnetic actuator 70, thereby closing the control valve 36 as valve land 44 engages valve seat 46. When the control valve is closed and the plunger 14 is driven in an upward direction by the camshaft follower 24, as shown in FIG. 1, a high injection pressure is developed in pumping chamber 16 and delivered to the nozzle holder assembly 54, which includes a needle valve housing 80 with injection orifices 78. Injection pressure acts on differential area 74 to lift needle valve 72 against the force of spring 76.

When the electromagnetic actuator is not energized, the control valve spring 32 pushes the control valve 36 towards its open position. This spring force is opposed by the spring force of the CCRS stop spring 82. The spring 32 has a higher spring rate than the spring 82. Thus, when the actuator 70 is deactivated, the force of spring 32 will overcome the force of spring 82, thereby shifting the valve 36 to its open position.

The unit pump system of FIGS. 1 and 1*a* has features that are common to the unit pump system described in U.S. Pat. No. 6,158,419. Reference may be made to that patent for the purpose of supplementing the present disclosure. The disclosure of the '419 patent is incorporated by reference in its entirety in the present disclosure. The '419 patent is assigned to the assignee of the present invention.

FIG. 2 shows a valve stop assembly of the kind used in the known construction disclosed in the '419 patent. It comprises a control valve stop body 84, which is received in a stop cavity corresponding to stop cavity 56 in FIG. 1*a*. A shoulder 86 is formed on the valve stop body 84, thereby limiting the extent to which the stop body extends into the pump body. The upper surface 88 of the valve stop body 84 is engaged by the valve seat end of the control valve. The control valve engages the stop surface 88 when the valve is fully open.

The valve stop body 84 has a cylindrical opening that receives a control valve stop piston 90. A stop spring 92, which is seated on a cap seal 94, moves the stop piston 90 in an upward direction, as viewed in FIG. 2. A shoulder 96 formed in the stop body 84 is engaged by a stop flange 98 on the piston 90. When the stop shoulder 96 is engaged by the flange 98, the upper end surface 100 of the piston 90 extends outwardly through end opening 102 of the stop body. When the piston 90 is positioned as shown in FIG. 2, the surface 100 is displaced from the surface 88 by a calibrated distance, which may be 120 microns in a typical injector environment.

When the control valve 36 is shifted to its fully closed position, a gap exists between the surface 100 and the end of the valve. When the control valve 36 is in its fully open position, the end of the valve will engage surface 100 and will compress stop spring 92 until the end of the valve engages surface 88 of the stop assembly. The total stroke of the control valve, as it moves from the fully open position to the fully closed position, may be about 150 microns. As the valve is shifted by the actuator to its closed position, the final travel of the control valve, which may be 30 microns, for example, would not be influenced by the stop piston 90 since the stop spring 92 is not active during the final travel of the valve over the last 30 micron interval towards the closed position. A higher current then is needed in the actuator as the valve 36 is closed. The engine control unit, not shown, will provide increased amperage to the actuator to effect closing movement of the valve. This results in a rise in the injection pressure.

Figure 6:
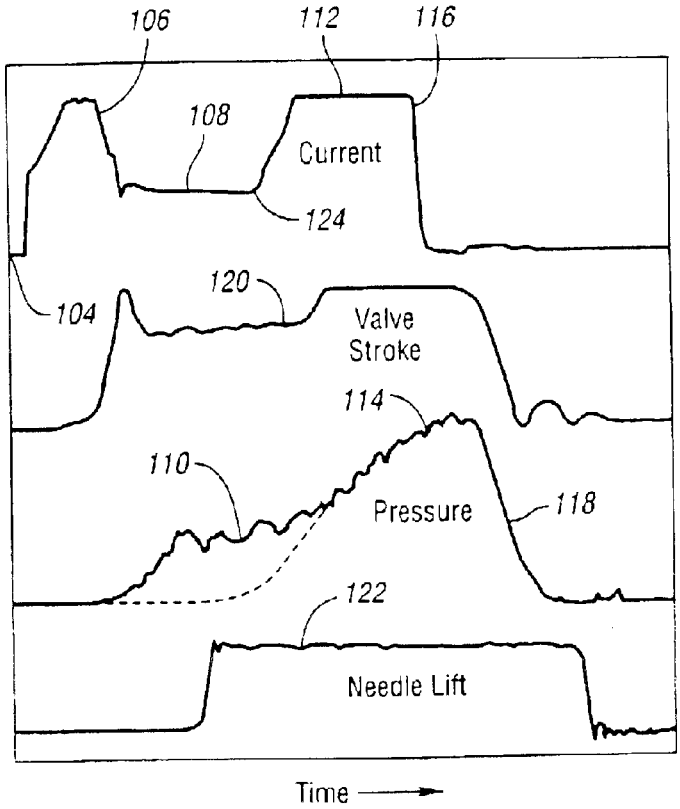
FIG. 6 is a time plot for solenoid current, valve stroke, injection pressure and nozzle needle motion for a unit pump system of the kind shown in FIGS. 1 and 1*a*.

FIG. 6 shows a time plot of the current trace, the control valve motion trace, the typical injection pressure trace previously mentioned (shown partly by a dotted line) and the nozzle needle motion trace. The current is zero at location 104. A so-called pull-in current is applied until it is detected that the control valve 36 hits the valve seat 46. The current is reduced to an intermediate level, as shown at 108, at an early instant in the injection event. The magnetic force generated by this current is not then high enough to seat the control valve 36 against the valve seat 46. The control valve 36 therefore will move to the intermediate position, which may be about 30 $\mu$m from the entirely closed position. Due to the wanted leak, the injection pressure stays constant at that instant or rises at a slower rate. This is indicated in FIG. 6 at 110 in the time plot of the injection pressure.

Following the current plot at 108, the current is rapidly increased again, as shown at 112. The pressure is ramped upward as a result of the ramping of the current from the level at 108 to the level at 112, thereby effecting the higher injection pressure at 114. The current is interrupted at 116, which results in a rapid decline in the pressure, as shown at 118.

The current is controlled, as shown in FIG. 6, in response to commands of an electronic engine control module (not shown) that monitors engine operating variables. The control module includes a processor with stored control algorithms to effect current control, which results in a pressure time plot of the kind shown in FIG. 6. This control technique thus is known as "current controlled rate shaping (CCRS)."

The stroking of the valve is demonstrated by the time plot for the valve, as indicated at 120. A corresponding needle lift plot is shown at 122 in FIG. 6 for the injector nozzle holder assembly 54.

The point at which engagement of the stop piston 90 with the stop shoulder 96 is interrupted is indicated in the current plot at 124. As explained previously, this is followed by an increase in the current, which results in a corresponding ramping of the pressure, as shown at 114. The stop spring has no effect at that time on the characteristics of the injection event.

When the valve is stroking through the intermediate pressure portion of the time plot of FIG. 6, the stop piston 90 is in engagement with the end of the control valve. Thus, the effective spring force acting on the valve is the algebraic sum of the two spring forces, one of which opposes the other. As previously indicated, the valve stroke during this portion of the injection event may be about 120 microns.

Figure 5A:
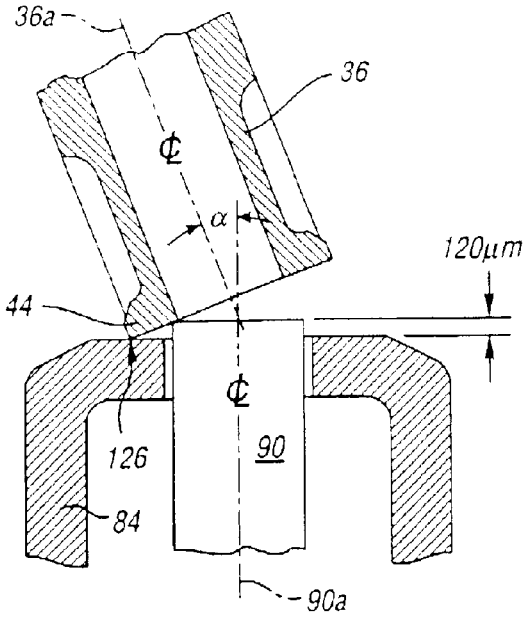
FIGS. 5*a* and 5*b* are schematic diagrams showing the manner in which the control valve cooperates with a stop assembly, FIG. 5 showing a conventional stop assembly and FIG. 5*b* showing, for purposes of comparison, the stop assembly of the invention.
Figure 5B:
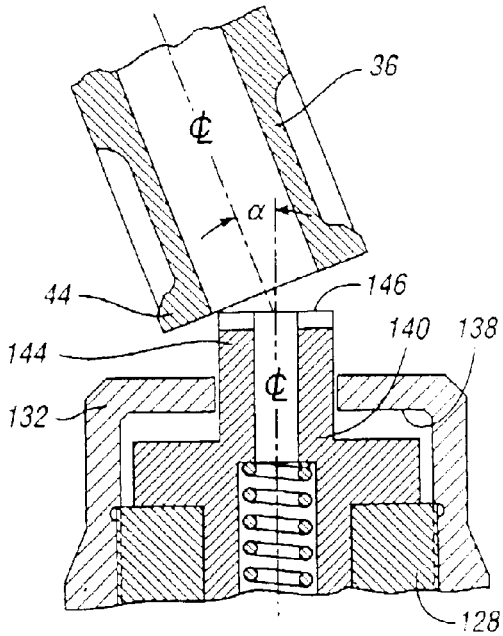

FIG. 5*a* illustrates schematically a condition that may arise during manufacture and assembly of a unit pump injection system or a unit injector system when a control valve stop piston and a valve stop body of the kind shown in FIG. 2 is used. It is possible that manufacturing tolerances may result in a misalignment $\alpha$ of the axis 90*a* of the stop piston 90 relative to the axis 36*a* of the valve 36. This misalignment, for example, may be about 0.5°, but the misalignment $\alpha$ illustrated schematically in FIGS. 5*a* and 5*b* is exaggerated for purposes of illustration.

It is seen in the diagram of FIG. 5*a* that piston 90 of a conventional design extends slightly outward (120 $\mu$m) from the stop body 84, as previously explained. If the control valve 36 is shifted to the open position, it will engage the stop piston 90 before it engages the stop body 84. If there is misalignment in the axes of the piston 90 and the control valve 36, the control valve 36 may contact the stop body before control valve 36 is fully open, as shown at 126 in FIG. 5*a*. This engagement of the control valve 36 with the stop body 84 may occur before the stop piston 90 is fully displaced into the stop body. This condition will seriously affect the performance of the injector and will alter the rate shaping illustrated in the pressure plot of FIG. 6.

Figure 3:
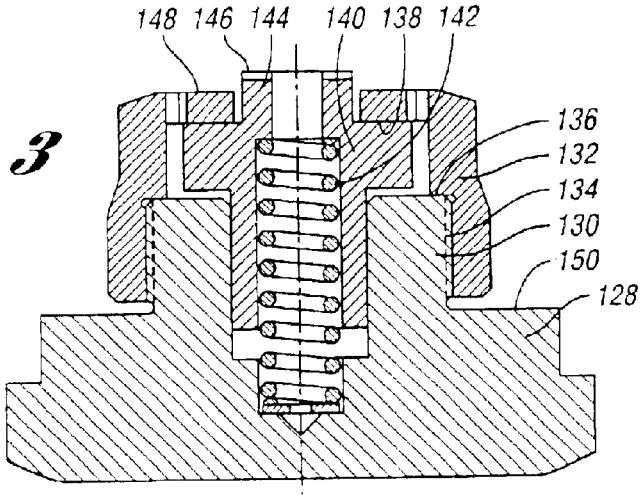
FIG. 3 is an adjustable stop assembly embodying characteristics of the present invention.
Figure 4:
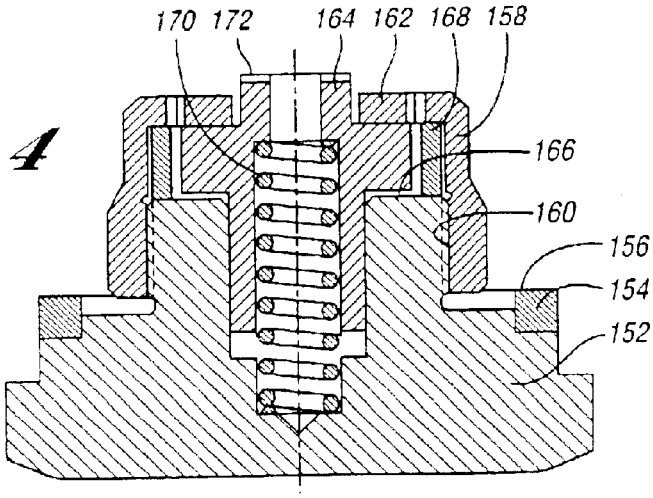
FIG. 4 is an alternative construction, corresponding to the construction of FIG. 3, embodying characteristics of the present invention.

In contrast to the design shown in FIG. 2, and in the schematic illustration of FIG. 5*a*, the adjustable valve stop of the present invention of FIGS. 3 and 4 will avoid the disadvantages resulting from misalignment of the control valve relative to the stop piston. In a first embodiment of the invention, shown in FIG. 3, a valve stop body 128 is provided with an extension 130, which receives a stop cap 132. The cap 132 can be threaded, welded, pressed on, clipped on, or crimped, for example, at 134 on the valve stop body 128 until it engages a shoulder 136. The cap 132 also has a calibrated shoulder 138, which is engaged by stop piston 140 when the piston is fully extended in an upward direction, as shown in FIG. 3. A stop piston spring 142, which is seated on the stop body 128, engages the piston 140 and urges it outwardly, as shown at 144. The end surface 146 on the piston 140 is displaced from the upper surface of shoulder 148 on the cap 132 a sufficient distance so that the valve end will always be in contact with the piston throughout the entire extent of its movement.

In FIG. 3, the stop body 128 has a shoulder 150, which engages the pump body when the assembly of FIG. 3 is received in the stop opening in the pump body. This shoulder 150 is precisely machined to close tolerances so that it is able to define the stroke of the valve. As previously explained, the overall stroke of the valve may be 150 microns.

Referring next to FIG. 4, an alternative construction of the valve stop assembly is shown. It includes a valve stop body 152, which corresponds to the valve stop body 128 of FIG. 3. The design of FIG. 4 does not have a shoulder corresponding to the precisely machined shoulder 150 of FIG. 3. Instead, the design of FIG. 4 includes a calibrated or categorized shim 154, which is controlled precisely with close dimensional tolerances so that the upper surface 156 of the shim 154 can precisely set the stroke of the valve, such as a stroke of 150 microns, as explained previously.

A cap 158 is received over the upper portion of the stop body 152 and is threadably connected, or otherwise secured, to it at 160. The cap 158 has an upper portion 162, which overlies a stop piston 164. The stop piston engages the cap 158, which limits the stroke of the piston, as indicated, to establish a gap at 166 between the piston and the valve stop body 152. A second calibrated or categorized shim 168 is located between the upper surface of the valve stop body and the upper portion 162 of the cap 158. As in the case of the shim 154, the shim 168 is precisely controlled with close tolerances so that it is capable of setting the travel of the piston 164 to a desired value, such as 120 microns, as explained previously.

The piston 164 is urged in an upward direction, as viewed in FIG. 4, by valve stop spring 170, which corresponds to valve stop spring 142 in the embodiment of FIG. 3. As in the case of the embodiment of FIG. 3, the piston 164 has an end surface 172, which is engaged by the control valve throughout the entire stroke of the valve in the stroke range permitted by the gap 166. The control valve will engage the piston 164 at a single contact location without engaging the cap 158 during its movement throughout the entire range of movement corresponding to the stroke of the piston 164.

The schematic illustration in FIG. 5*b* shows the relative positions of the control valve 36 and the stop cap 132 for the design of FIG. 3 when the control valve and the control valve stop are misaligned. It can be seen that the control valve can be stroked to its fully open position without interference between the end of the control valve and the cap 132.

The valve stop assemblies of FIGS. 3 and 4 are less costly in a high volume manufacturing operation because they can be assembled "off line" independently of the final assembly of the components of the injector assembly. They can be assembled in the pump body of the injector in a single, simple assembly step. This is in contrast to the relatively complex assembly procedure that would be required for a stop assembly of the kind shown, for example, in FIG. 2.

By accurately controlling the gap between the stop assembly and the end of the control valve, which may be 30 microns as explained previously, a more precisely controlled shape of the time plot of the injection pressure for a unit pump or the unit injector during the initial phase of the injection event is achieved, whereby a modified pressure of controlled magnitude and duration is established. This precise control has been found to greatly improve engine exhaust gas emission quality.

Although embodiments of the invention have been disclosed, it will be apparent to persons skilled in the art that modifications may be made without departing from the scope of the invention. All such modifications and improvements thereof are intended to be included within the scope of the following claims.

What is claimed is:

1. A fuel injector for an internal combustion engine comprising:

a pump body defining a cylindrical opening, a piston plunger in the cylindrical opening defining with the cylindrical opening a pumping chamber;

a fuel inlet passage and a fuel return passage;

a cam follower connected to the piston plunger, the engine having a camshaft that drives the follower during a fuel pumping stroke of the piston plunger;

a fuel injection nozzle for fueling the engine;

a fuel delivery passage connecting the pumping chamber and the nozzle;

a movable control valve communicating with the fuel delivery passage, the control valve having a valve land and a cooperating valve seat defining in part a spill flow path from the fuel delivery passage to the fuel return passage when the control valve is moved in one direction and interrupting the spill flow path when the control valve is moved in the opposite direction;

a valve spring for shifting the control valve in the one direction and an electromagnetic actuator for shifting the control valve in the opposite direction;

the inlet passage communicating with the pumping chamber through the control valve when the control valve is moved in the one direction whereby the pumping chamber is filled as the piston plunger is retracted following its pumping stroke; and a stop assembly in the pump body adjacent one end of the control valve including a stop body, a stop piston in the stop body engageable with the control valve when it is moved in the one direction to a first stop position of the control valve, the stop piston engaging the stop body when the control valve is moved to a second stop position thereby limiting stroking of the control valve in the one direction;

the control valve being separated from the stop piston by a calibrated gap when the valve land engages the valve seat;

the control valve being engageable with the stop piston as it is moved to the second stop position without engaging the stop body regardless of misalignment of the stop assembly relative to the control valve.

2. The fuel injector set forth in claim 1 wherein the stop assembly comprises a stop spring acting on the stop piston, the net spring force acting on the control valve as the control valve engages the stop piston being equal to the difference between the forces of the valve spring and the stop spring.

3. The fuel injector set forth in claim 2 wherein the second stop position is defined by a first stop shoulder on the stop body that limits travel of the stop piston in the one direction, and a stop cap on the stop body defining a second stop shoulder that limits travel of the stop piston in the opposite direction.

4. The fuel injector set forth in claim 3 wherein the second shoulder is formed on the stop cap, the stop cap being a separate element of the stop assembly, the second stop shoulder on the stop cap being engageable with the stop piston as the stop piston extends toward the control valve whereby contact between the control valve and the stop body is avoided.

5. The fuel injector set forth in claim 4 wherein the second stop shoulder has a position defined by a calibrated shim engaging the stop cap.

6. The fuel injector set forth in claim 5 wherein the position of the stop assembly in the pump body is defined by a second calibrated shim between the stop body and the pump body.

7. The fuel injector set forth in claim 2 wherein the stop body includes a stop spring pocket receiving one end of the stop spring, the stop piston having a spring opening receiving the other end of the stop spring whereby the stop assembly can be pre-assembled during manufacture independently of final assembly of a complete fuel injector.

8. The fuel injector set forth in claim 3 wherein the stop body includes a stop spring pocket receiving one end of the stop spring, the stop piston having a spring opening receiving the other end of the stop spring whereby the stop assembly can be pre-assembled during manufacture independently of final assembly of a complete fuel injector.

* * * * *